US010119756B2

(12) United States Patent
Parsnick et al.

(10) Patent No.: US 10,119,756 B2
(45) Date of Patent: Nov. 6, 2018

(54) OXYGEN BACKUP METHOD AND SYSTEM

(71) Applicants: PRAXAIR TECHNOLOGY, INC., Danbury, CT (US); David Parsnick, Shanghai (CN); James P. Meagher, Buffalo, NY (US); John F. Billingham, Getzville, NY (US); Gerald A. Paolino, Lancaster, NY (US)

(72) Inventors: David Parsnick, Amherst, NY (US); James Meagher, Buffalo, NY (US); Gerald A. Paolino, Lancaster, NY (US); John F. Billingham, Getzville, NY (US)

(73) Assignee: PRAXAIR TECHNOLOGY, INC., Danbury, CT (US)

( * ) Notice: Subject to any disclaimer, the term of this patent is extended or adjusted under 35 U.S.C. 154(b) by 535 days.

(21) Appl. No.: 14/907,608

(22) PCT Filed: Oct. 23, 2013

(86) PCT No.: PCT/CN2013/085754

§ 371 (c)(1),
(2) Date: Jan. 26, 2016

(87) PCT Pub. No.: WO2015/058366

PCT Pub. Date: Apr. 30, 2015

(65) Prior Publication Data

US 2016/0161180 A1 Jun. 9, 2016

(51) Int. Cl.

| | |
|---|---|
| ***F25J 3/02*** | (2006.01) |
| ***F17C 13/00*** | (2006.01) |
| ***F25J 3/04*** | (2006.01) |

(52) U.S. Cl.

CPC ..... *F25J 3/0295* (2013.01); *F17C 13/00* (2013.01); *F25J 3/0409* (2013.01); *F25J 3/0489* (2013.01);

(Continued)

(58) Field of Classification Search

CPC .... F25J 3/04478; F25J 3/0449; F25J 3/04496; F25J 3/04824; F25J 3/04963; F25J 2280/30; F25J 2290/62

(Continued)

(56) References Cited

U.S. PATENT DOCUMENTS 3,485,053 A * 12/1969 Grenier ..... F25J 1/0204 62/149
5,941,098 A 8/1999 Guillard et al.

(Continued)

FOREIGN PATENT DOCUMENTS

CN 102322726 A 1/2012
CN 103196278 A 7/2013

(Continued)

OTHER PUBLICATIONS

Mason Publications,Research Disclosure, 446104 Publication, Hampshire, GB, No. 446, Jun. 1, 2001, pp. 988-991, XP001100185, ISSN: 0374-4353.

*Primary Examiner* — Tareq Alosh
(74) *Attorney, Agent, or Firm* — Robert J. Hampsch

(57) ABSTRACT

A method and backup system for backing up a supply oxygen in an air separation plant in which during normal operation, a stream of oxygen-rich liquid is pumped through a main flow path, extending from a surge tank to a heat exchanger, to deliver an oxygen product. The surge tank receives the oxygen-rich liquid from a bottom region of the lower pressure column of the plant. Additionally, during normal operations, a stream of the oxygen-rich liquid is also introduced to a reserve storage tank through a backup flow path. During a transient operation, where the air separation plant has ceased operation, the surge tank is isolated and liquid is pumped from the surge tank through an auxiliary flow path to an auxiliary vaporizer to continue the supply of (Continued)

the oxygen product and the surge tank is replenished with oxygen-rich liquid previously stored in the reserve storage tank.

10 Claims, 1 Drawing Sheet

(52) U.S. Cl.
CPC ..... *F25J 3/04187* (2013.01); *F25J 3/04478* (2013.01); *F25J 3/04818* (2013.01); *F25J 3/04824* (2013.01); *F25J 3/04963* (2013.01); *F25J 2235/50* (2013.01); *F25J 2245/50* (2013.01); *F25J 2250/50* (2013.01); *F25J 2290/62* (2013.01)

(58) Field of Classification Search
USPC ..... 62/50.1
See application file for complete search history.

(56) References Cited

U.S. PATENT DOCUMENTS

| | | | | | |
|---|---|---|---|---|---|
| 6,155,078 | A * | 12/2000 | Miyashita | ..... | F25J 3/04157 62/643 |
| 6,889,524 | B2 * | 5/2005 | O'Connor | ..... | F17C 9/02 62/50.2 |
| 2008/0184736 | A1 | 8/2008 | Peyron | | |
| 2013/0269387 | A1 * | 10/2013 | Briglia | ..... | F25J 3/0409 62/643 |

FOREIGN PATENT DOCUMENTS

| | | | | | |
|---|---|---|---|---|---|
| JP | 06347163 | A * | 12/1994 | ..... | C12C 7/0685 |
| JP | 3676668 | B2 * | 7/2005 | ..... | F25J 3/0403 |
| JP | 3884240 | B2 * | 2/2007 | ..... | F25J 3/0409 |
| JP | 4688843 | B2 * | 5/2011 | ..... | F25J 3/0409 |
| WO | WO 2009/137213 | A2 | 11/2009 | | |

* cited by examiner

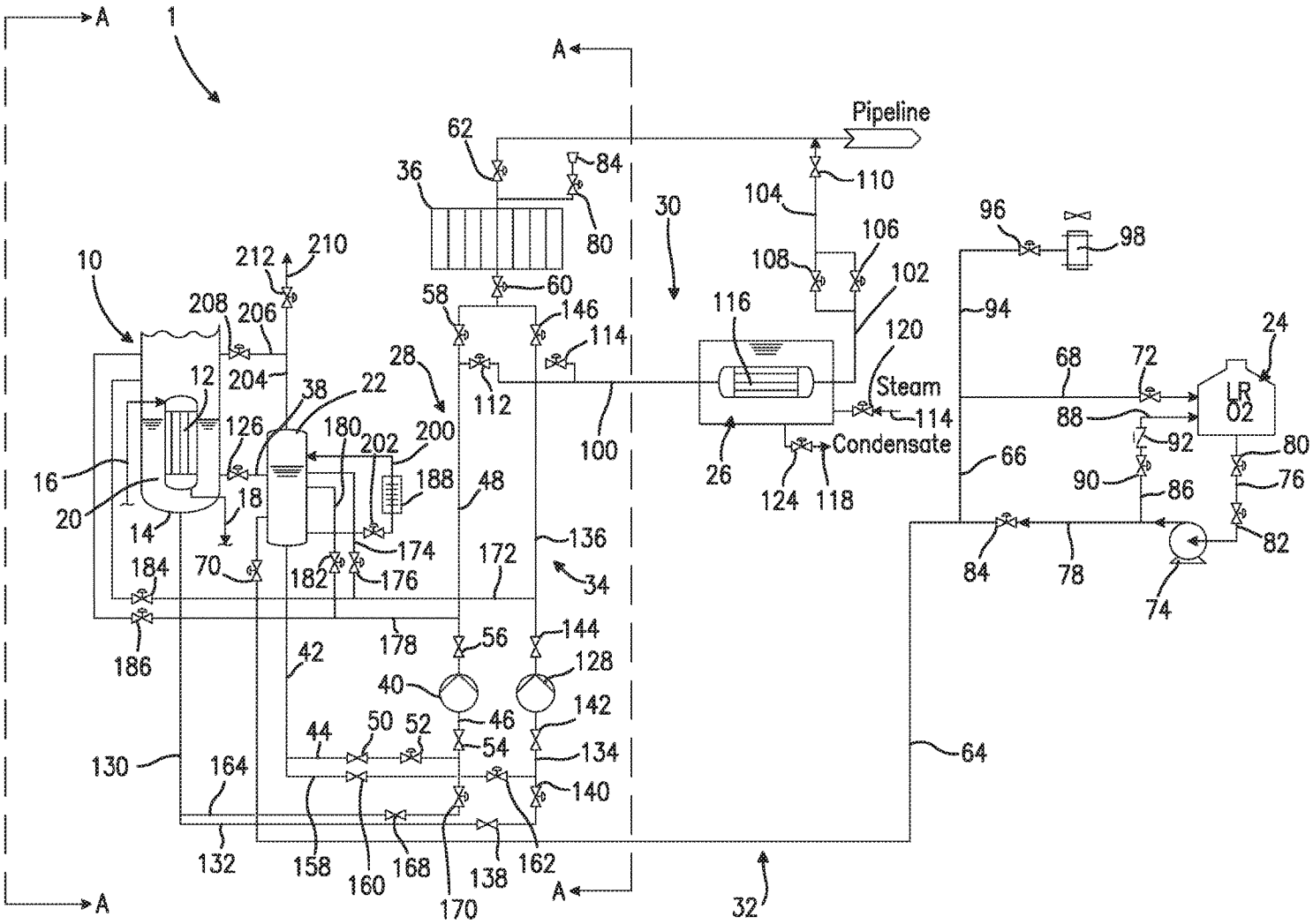
Pipeline
Steam
Condensate
LR
O2
A
A

OXYGEN BACKUP METHOD AND SYSTEM

FIELD OF THE INVENTION

The present invention relates to a method and system for backing up the supply of oxygen in an air separation plant in which a liquid oxygen stream composed of an oxygen-rich liquid column bottoms of a lower pressure column of the air separation plant is pumped and then heated to supply the oxygen. More particularly, the present invention relates to such a method and system in which, during normal operation of the air separation plant, the oxygen-rich liquid stream is pumped from a surge tank connected to the lower pressure column and then to a heat exchanger of the air separation plant and alternatively, during a transient operation where the air separation plant has ceased operation, to an auxiliary vaporizer. Even more particularly, the present invention relates to such a method and system in which, during transient operation, the surge tank is replenished with liquid oxygen previously stored in a reserve storage tank during the normal operation.

BACKGROUND

Oxygen is supplied through the cryogenic separation of air within an air separation plant. As well known in the art, the air is separated in such a plant by compressing, purifying and cooling then air to a temperature suitable for the distillation thereof and then separating the air in a distillation column system. The distillation column system typically utilizes a higher pressure column and a lower pressure column that are thermally linked. Within the higher pressure column, the air is separated into a nitrogen-rich vapor column overhead and an oxygen-rich liquid column bottoms known as kettle liquid or crude liquid oxygen. The column bottoms is further refined in the lower pressure column to produce an oxygen-rich liquid as a column bottoms. The linkage between the columns can be effected by means of a condenser reboiler situated within the lower pressure column to vaporize part of the oxygen-rich liquid column bottoms against condensing the nitrogen-rich vapor of the higher pressure column. The condensed nitrogen-rich vapor can be used as reflux for both of the columns and the resulting heated oxygen-rich liquid serves as boil-up for the lower pressure column.

The oxygen is supplied from the air separation plant by heating an oxygen-rich stream composed of the oxygen-rich liquid column bottoms produced in the lower pressure column within a heat exchanger used in cooling at least part of the air. Where the oxygen is desired at high pressure, the oxygen-rich liquid stream can be pumped before being heated either to produce a high pressure vapor or a supercritical fluid after having been heated. There are many applications where the operator of the air separation plant has to guarantee the supply of oxygen. In certain applications, even intermittent interruptions of the oxygen supply are not permissible. A supply failure can be occasioned by a cessation of the normal operation of an air separation plant that can be caused by a failure of a key component, for instance, a compressor or turbine trip. In such case, the air separation plant warms and the liquid within the distillation columns falls to bottom regions thereof. When the plant is able to be restarted, the purity of the oxygen may not be high enough to use in the particular contracted application. As such, even after a plant restart, there is a further delay until the plant can be brought back on line, one again, supplying the oxygen.

In order to assure the delivery of the oxygen at pressure, it is known to accumulate a portion of the liquid oxygen produced within the plant within a remote storage tank or other reservoir. During a transient event when the plant operation is interrupted, the oxygen can be pumped from the storage tank to an auxiliary vaporizer in order to supply the oxygen during the transient. Typically, a set of pumps is provided in the cold box of the air separation plant for pumping the oxygen-rich liquid during normal operations and another set of pumps associated with the storage tank is also provided for pumping the oxygen-rich liquid during the transient. This represents a considerable capital expense given that two sets of pumps and associated valves and instrumentation must be purchased, operated and maintained and that these pump must be specified for high pressure oxygen service.

Another arrangement is shown in United States Patent Application No. 2008/0184736. In this case, liquid flows from the low pressure column sump to an external storage tank from which it is pumped and sent to the plant heat exchanger. The problem with this type of plant design is that liquid is continually exported from the plant to the storage tank and along with such export, refrigeration that would otherwise maintain the plant in balance due to heat leakage into a cold box used in containing the distillation columns and warm end losses from the plant heat exchanger. This is exacerbated by the fact that the large liquid reservoir contains also the liquid to be used for extended back-up during transients and due to its size may be located some distance from the column cold box. Thus, there are losses in this type of installation that are compensated by supplying increased refrigeration at an increase in the overall power consumption of the plant.

As will be discussed, the present invention provides a method and oxygen supply system to be used in connection with an air separation plant in which, among other advantages, can be effectuated that does not use extra pumps that are solely associated with supplying oxygen during a plant transient event and that inherently operates in a more energy efficient manner.

SUMMARY OF THE INVENTION

The present invention provides a method of backing up a supply oxygen within an air separation plant in which a liquid oxygen stream composed of an oxygen-rich liquid is pumped to produce a pumped liquid oxygen stream. The oxygen-rich liquid results from indirect heat exchange between downcoming liquid of a lower pressure column and nitrogen-rich vapor column overhead of a higher pressure column of the air separation plant. The pumped liquid oxygen stream is heated to produce the supply of the oxygen.

During normal operation of the air separation plant, streams of the oxygen-rich liquid are fed to a surge tank and a reserve storage tank of larger volume than the surge tank and situated more remotely from the lower pressure column than the surge tank, at least on an intermittent basis, so that the oxygen rich liquid is accumulated in the surge tank and the oxygen-rich liquid is stored within the reserve storage tank as a backup supply. The pumped liquid oxygen stream is heated within a heat exchanger used in cooling at least a portion of the air to a temperature suitable for the cryogenic rectification thereof within the air separation plant. This vaporization thereby produces the supply of the oxygen during the normal operation.

During a transient operation of the air separation plant where, the air separation plant has ceased operation, the surge tank is isolated so that the surge tank does not receive the oxygen-rich liquid. The liquid oxygen stream during such time is pumped from the surge tank to produce the pumped liquid oxygen stream and the pumped liquid oxygen stream is now heated within an auxiliary vaporizer to produce the supply of the oxygen during the transient operation. The surge tank is replenished with a back-up stream of the oxygen-rich liquid removed from the reserve storage tank. This back-up stream composed of the back-up supply within the reserve storage tank.

Since the oxygen-rich liquid is pumped from the surge tank to the plant heat exchanger both in case of the normal operation and the transient operation of the air separation plant, there is no requirement that a separate pump capable of delivering pressures required for delivery of product be provided to pump liquid oxygen from the reserve storage tank during the transient operation. Thus, the practice of the present invention results in a lower cost through elimination of the cost of obtaining, operating and maintaining a separate high pressure pumps associated with the reserve storage tank for transient operations. While as will be discussed, practically liquid is motivated from the reserve storage tank with the use of a transfer pump, such a pump is a low cost item that is not capable of pumping the oxygen-rich liquid to delivery pressures that would normally be required in the practical supply of a pressurized oxygen product. Moreover, there are energy savings that are inherent in the present invention over the prior art. Since the surge tank is located closer to the air separation plant than the reserve storage tank and has a smaller volume thereof, there are less refrigeration losses in the present invention than in the prior art where the oxygen-rich liquid stored in reserve is continually being sent to and supplied from a reserve storage tank situated a distance away from the air separation plant. Moreover, since the surge tank is of smaller volume than the reserve storage tank, it can be located in the cold box housing the columns of the plant or at the very least placed directly outside of the coldbox with a very short insulated piping run to also lessen losses. Further, the proximity of the surge tank and the operating pressure of the surge tank relative to the storage tank means that flash off vapor generated from heat leakage and recirculation from the oxygen pumps directed back to the respective tanks is more readily captured and returned to the process in the case of the surge tank.

Preferably, during normal operation, of the air separation plant, the surge tank continually receives one of the streams of the oxygen-rich liquid and thereby continually accumulates the oxygen-rich liquid within the surge tank and the liquid oxygen stream is pumped from the surge tank to produce the pumped liquid oxygen stream.

The surge tank can be connected to a bottom region of the lower pressure column to receive the one of the streams of the oxygen-rich liquid. During the transient operation of the air separation plant, the air separation plant is restarted and during the restart of the air separation plant, an impure liquid oxygen stream is separately pumped from the liquid oxygen stream from a bottom region of the lower pressure column and is thereafter, heated in the heat exchanger until a production purity is obtained in the impure liquid oxygen stream that is equal to that of the liquid oxygen stream. After the production purity is obtained, the surge tank is reconnected to the lower pressure column to receive one of the streams of the oxygen rich liquid and the separate pumping of the impure liquid oxygen stream is ended. The liquid oxygen stream can be pumped by a main pump and the impure liquid oxygen stream pumped by a standby pump within two parallel flow paths. Each of the parallel flow paths, at one end, is able to be selectively connected to the bottom region of the lower pressure column or alternatively, the surge tank. At the other end, each of the flow paths is able to be selectively connected to the heat exchanger or, alternatively, the auxiliary vaporizer so that the standby pump is also able to pump the liquid oxygen in place of the main pump and the main pump is also able to pump the impure liquid oxygen stream in place of the standby pump. The standby pump can be continually operated during the normal operation of the air separation plant through recirculation of a portion of the oxygen-rich liquid along a recirculation path so as to maintain the pump in a cold ready condition and minimize the interruption to product supply in the event that the main pump fails.

In any embodiment of the present invention, the reserve storage tank can be connected to the surge storage tank to receive another of the streams of the oxygen-rich liquid from the surge tank during normal operation of the air separation plant.

The present invention also provides a backup system for backing up the supply oxygen within an air separation plant. In accordance with this aspect of the present invention, a surge tank and a reserve storage tank are provided to receive streams of an oxygen-rich liquid resulting from indirect heat exchange between downcoming liquid of a lower pressure column and nitrogen-rich vapor column overhead of a higher pressure column of the air separation plant. The reserve storage tank has a larger volume than the surge tank and is situated more remotely from the lower pressure column than the surge tank. Additionally an auxiliary vaporizer, a flow network and a system of control valves are provided.

The flow network has a main flow path, an auxiliary flow path and a backup flow path. The main flow path is connected to a heat exchanger used in cooling at least a portion of the air to a temperature suitable for the cryogenic rectification thereof and contains a main pump for pumping a liquid oxygen stream to produce a pumped liquid oxygen stream and to introduce the pumped liquid oxygen stream into the heat exchanger for heating the pumped liquid oxygen stream. The auxiliary flow path extends between the main flow path, between the heat exchanger and the main pump and the auxiliary vaporizer for alternately heating the pumped liquid stream and thereby supplying the oxygen. The backup flow path extends between the surge tank and reserve storage tank and contains a transfer pump to pump a backup stream of the oxygen-rich liquid to the surge tank and thereby replenish the surge tank with the oxygen-rich liquid.

The system of control valves are able to be selectively activated so that during normal operation of the air separation plant, the streams of the oxygen-rich liquid are fed to the surge tank, at least on an intermittent basis, and the reserve storage tank so that the oxygen-rich liquid is accumulated in the surge tank and the oxygen-rich liquid is stored within the reserve storage tank as a back-up supply and the pumped liquid oxygen stream is produced in the main flow path and is heated in the heat exchanger to supply the oxygen. During a transient operation of the air separation plant, where the air separation plant has ceased operation, the system of control valves is able to be selectively activated such that the surge tank is isolated so that it does not receive the oxygen-rich liquid, the pumped liquid oxygen stream vaporizes in the auxiliary vaporizer to supply the oxygen and the surge tank is replenished with the backup stream through the backup flow path with the use of the transfer pump.

Preferably, the main flow path extends from the surge tank to the heat exchanger. Further, the system of control valves is able to be selectively activated such that during normal operation of the air separation plant, the surge tank continually receives one of the streams of the oxygen-rich liquid and the oxygen-rich liquid thereby continually accumulates in the surge tank and the liquid oxygen stream is pumped by the main pump from the surge tank to produce the pumped liquid oxygen stream.

The surge tank can be connected to a bottom region of the lower pressure column to receive the one of the streams of the oxygen-rich liquid. During the transient operation of the air separation plant, the air separation plant can be restarted. For such purposes, the flow network has a standby flow path that extends between a bottom region of the lower pressure column to the heat exchanger and that contains a standby pump able to be activated so that during the restart of the air separation plant, an impure liquid oxygen stream is separately pumped from the liquid oxygen stream from a bottom region of the lower pressure column and is thereafter, heated in the heat exchanger until a production purity is obtained in the impure liquid oxygen stream that is equal to that of the liquid oxygen stream. In such embodiments, the system of control valves is able to be selectively activated so that the standby flow path is able to be connected to the bottom region of the lower pressure column and the heat exchanger when the surge tank is isolated and alternatively, the standby flow path is able to be isolated from the bottom region of the lower pressure column and the heat exchanger when the production purity has been obtained and normal operation of the air separation plant is resumed. Preferably, the main flow path and the standby flow paths are two parallel flow paths, each, at one end, extending between the bottom region of the lower pressure column and the surge tank and, at the other end, the heat exchanger and the auxiliary flow path. In this embodiment, the system of control valves is able to selectively connect each of the two parallel flow paths between the bottom of the lower pressure column and the heat exchanger, the surge tank and the heat exchanger and the surge tank and the auxiliary flow path so that the standby pump is also able to pump the liquid oxygen in place of the main pump and the main pump is also able to pump the impure liquid oxygen stream in place of the standby pump. A recirculation path is connected to the standby path so that the standby pump is able continually operated during the normal operation of the air separation plant through recirculation of a portion of the oxygen-rich liquid along the recirculation path.

Preferably, where the surge tank continually accumulates the oxygen-rich liquid during normal operation, the control valves are able to be selectively activated so that so that the reserve storage tank receives another of the streams of the oxygen-rich liquid from the surge tank and through the backup flow path to store the oxygen-rich liquid during the normal operation of the air separation plant.

BRIEF DESCRIPTION OF THE DRAWING

Although the specification concludes with claims distinctly pointing out the subject matter that Applicants regard as their invention, it is believed that the invention will be better understood when taken in connection with the accompanying drawings in which the sole FIGURE is a fragmentary, schematic view of an air separation plant incorporating a backup system for carrying out a method in accordance with the present invention.

DETAILED DESCRIPTION

With reference to the sole FIGURE, relevant equipment of an air separation plant 1 is illustrated into which a backup system in accordance with the present invention is incorporated. The air separation plant 1, as well known in the art, incorporates a lower pressure column 10 that is thermally integrated with a higher pressure column, not illustrated, by means of a condenser reboiler 12 located in a bottom region 14 of the lower pressure column 10. In practice, a nitrogen-rich vapor stream 16 composed of column overhead of the higher pressure column is condensed within the condenser reboiler 12 to produce a liquid nitrogen stream 18. Liquid nitrogen stream 18 is used to form liquid nitrogen reflux for the higher pressure column and typically the lower pressure column. Additionally, some liquid can be taken as a product or pumped to a higher pressure and heated to deliver a high pressure gaseous product. As also well known, the higher pressure column produces a crude oxygen-rich liquid, also known as kettle liquid, that is further refined in the lower pressure column 10. This further refinement produces downcoming liquid that is ever more rich in oxygen as it descends in the column. Such liquid, in the illustrated embodiment, collects in a sump to indirectly exchange heat with the nitrogen-rich vapor stream 16. Residual liquid that does not vaporize, collected in the column sump, produces an oxygen-rich liquid as an oxygen-rich liquid column bottoms 20.

It is understood that although the air separation plant 1 has thus far been described relative to the lower pressure column 10, in practice, the condenser reboiler 12 could be located within a shell separated from the lower pressure column 10, yet connected to the lower pressure column 10 to return residual oxygen-rich liquid and boil-up to the lower pressure column. In case of either the use of a separate condenser reboiler 12 located in a shell or a condenser reboiler 12 located in a bottom region of the lower pressure column, the oxygen-rich liquid is formed as a result of the indirect heat exchange between the nitrogen-rich vapor column overhead produced in the higher pressure column and the downcoming liquid resulting from further refinement of the crude liquid oxygen in the lower pressure column 10.

The air separation plant 1 incorporates a backup system that will allow delivery of an oxygen product during normal operation of the plant, or alternatively, during a transient operating condition where the air separation plant 1 has ceased operation. The backup system has a surge tank 22, a reserve storage tank 24, an auxiliary vaporizer 26 and a flow network connecting such components and having control valves to direct oxygen-rich liquid along flow paths of the flow network during both the normal and transient operating conditions. The flow paths of the flow network include a main flow path 28, an auxiliary flow path 30 and a back-up liquid flow path 32. Additionally, a standby flow path 34 can optionally be included within the flow network.

More specifically, the main flow path 28 extends between the surge tank 22 and a heat exchanger 36 and the backup liquid flow path 32 extends between the surge tank 22 and the reserve storage tank 24. During normal operation of the air separation plant, streams of the oxygen-rich liquid are delivered to the surge tank 22 by means of a conduit 38 and to the reserve storage tank 24 by way of the backup flow path 32. As a result, the oxygen rich liquid is accumulated in the surge tank 22 and the oxygen-rich liquid is stored within the reserve storage tank 24 as a backup supply. It is to be noted that the reserve storage tank 24 is of larger volume than the surge tank 22 and situated more remotely from the lower pressure column 10 than the surge tank 22. In this regard, the reserve storage tank is sized to meet the customer needs for a period of time typically on the order of 12 to 72 hours. The surge tank is sized so as to allow sufficient time to ensure that the transfer pump 74 can be primed and started, typically 0.5 to 2 hours. What this allows is for the surge tank 22 to be located in the cold box of the air separation plant 1 shown by the dashed lines and the arrowheads "A". As known in the art, in order to minimize heat leakage the distillation columns, the piping and equipment would normally be located in an insulated enclosure known in the art as a coldbox to minimize ambient heat leakage into such components. It is to be noted that the surge tank 22 could be located outside of the coldbox. However, this would require a separate insulation encasing the surge tank 22 to insulate such tank. In such case, the surge tank 22 would be located in close proximity to the lower pressure column 10 to minimize the lengths of piping runs and thereby reduce losses. The reserve storage tank 24 is located a further distance away from the lower pressure column 10 than the surge tank and 22. As such, reserve storage tank 24 would be separately insulated and the piping forming the backup flow path 32 would incorporate insulation.

The oxygen-rich liquid accumulated in surge tank 22, is continually expelled from the surge tank 22 and flows to the heat exchanger 36 along the main flow path 28. The main flow path 28 contains a main pump 40 and is formed by conduits 42, 44, 46 and 48. A liquid oxygen stream formed from oxygen-rich liquid contained in the surge tank 22 is pumped by the main pump 40 to produce a pumped liquid oxygen stream that is heated in the heat exchanger 36 to produce a product oxygen stream at pressure that can be supplied to a pipeline, as illustrated, or other use requiring high pressure oxygen. In this regard, if the oxygen is pressurized by the main pump 40 to a supercritical pressure, the oxygen product will be a supercritical fluid when warmed to ambient temperature within the heat exchanger 36. If pressurized to a sub-critical pressure, vaporization will occur to supply the oxygen product as a gas at pressure. The heat exchanger 36 is used in cooling at least part of the air to a temperature suitable for its distillation. Typically, it will be a series of such heat exchangers of brazed aluminum fin construction set in parallel. Where the liquid oxygen stream is to be pumped to a supercritical pressure, the heat exchangers can be banked with heat exchangers designed to operate at the high pressure of the pumped oxygen stream and a relatively lower pressure of air supplied to the higher pressure column for distillation. In such case, heat exchanger 36 would be the heat exchanger designed to operate at the high pressure.

The main flow path 28 contains valves 50, 52, 58, 56 and 58 that are all set in open position to enable the flow of the pumped liquid oxygen stream to the heat exchanger 36. Valves 60 and 62 are also set in open positions to enable the delivery of the oxygen product to the pipeline or other use. Valves 50, 54 and 56 are normally set in open positions, but can be closed for isolation purposes during maintenance of equipment, for instance, main pump 40.

The backup flow path 32 incorporates conduits 64, 66 and 68 to supply the oxygen-rich liquid to the reserve storage tank 24. However, it is understood that during normal operation the oxygen-rich liquid is only supplied as necessary to maintain the reserve storage tank 24 filled with liquid; and therefore, such supply is typically on an intermittent basis. In this regard, during the supply control valves 70 and 72 are set in open positions for such purposes. The backup flow path 32 is also designed to supply the oxygen-rich liquid stored in reserve storage tank 24 during the transient operation of the air separation plant 1. For such purposes, a transfer pump 74 is provided to pump a backup stream of the oxygen-rich liquid to the surge tank 22. The transfer pump 74 is set between the conduit 64 and the reserve storage tank 24 by means of conduits 76 and 78 having valves 80, 82 and 84 that would be set to an open position during such transient operational time to deliver the backup stream of the oxygen-rich liquid to the surge tank 22. In addition to the foregoing, a recycle loop is provided by conduits 86 having a control valve 90 and a check valve 92, respectively. During normal operation, transfer pump 74 could be continually operated in a cold condition by recirculating oxygen-rich liquid along such recycle loop from and back to the liquid reserve tank 24. During such recycling, valve 84 would be set in a closed position. In addition to the foregoing, the backup flow path 32 can also incorporate a conduit 94 and control valve 96 that can be set in an open position to supply excess oxygen-rich liquid to a drain vaporizer 98 for disposal.

During a transient where the air separation plant 1 is no longer in operation, for example due to a failure of a key component such as a main air compressor, the pumped liquid oxygen produced by pumping the liquid oxygen stream is supplied to the auxiliary vaporizer 26 through the auxiliary flow path that extends between the auxiliary vapor 26 and the main flow path 28, between the heat exchanger 36 and the main pump 40 by means of a conduit 100. The pumped liquid oxygen is vaporized in the auxiliary vaporizer 26, bypassing the heat exchanger 36. In the illustrated embodiment, since the oxygen product is to be supplied to a pipeline, conduits 102 and 104 would be provided for such purposes. The conduits 104 could contain control valves 106, 108 and 110. As shown, control valves 106 and 108 are in parallel flow paths and either can be set in a closed position upon a piping failure in one of the flow paths. Control valve 110 would be set in an open position to supply the oxygen product during the transient. In order to appropriately route the pumped liquid oxygen to the auxiliary vaporizer 26, the heat exchanger 36 is at least initially isolated by setting control valves 60 and 62 in closed positions and a control valve 112 in an open position. Control valve 114, which will be discussed hereinafter, is set in a closed position. In the illustrated embodiment, auxiliary vaporizer 26 is supplied with a steam 114 to heat the pumped oxygen-rich liquid within a heat exchanger 116 thereof. As a result, the steam condenses to form condensate that is discharged as a condensate stream 118. Control valves 120 and 124 can be set in open positions for such purposes and returned to closed positions when normal operation is resumed.

During the time of transient operation, transfer pump 74 pumps a stream of backup oxygen-rich liquid from the reserve storage tank 24 to surge tank 22 to continually replenish the surge tank 22 with liquid oxygen. Valves 70, 84, 82 and 80 are set in open positions for such purposes and valves 90, 72 and 96 are set in closed positions. At the same time a valve 126 is closed, isolating the surge tank 22 so that it no longer receives oxygen-rich liquid from the lower pressure column 10. This is particularly important because during a failure of the air separation plant 1, the liquid held up within the low pressure column would dump into the bottom of the lower pressure column 10 without enrichment causing the sump liquid to become too impure to be able to be utilized for product production.

As could be appreciated, whether air separation plant 1 could be restarted during the transient time interval, would of course be dependent upon the scope and impact of the failure. However, where the air separation plant 1 could be restarted prior to the consumption of all of the backup oxygen-rich liquid within reserve storage tank 24, the oxygen made by the air separation plant 1 will take time to meet inevitable customer, purity specifications. In order to allow the oxygen purity to meet such specification, an impure liquid oxygen stream is pumped by a standby pump 128 within the standby flow path 34 that extends from the bottom region of the lower pressure column 10 to the heat exchanger 36 and that consists of conduits 130, 132, 134 and 136. Valves 138, 140, 142, 144 and 146 are set in open positions. Valve 60 is also set in an open position along with a valve 80 leading to a vent 84. Valve 62 remains set in the closed position. This results in an impure liquid oxygen stream from the bottom of the lower pressure column 10 to be pressurized by standby pump 128, vaporized in the heat exchanger 36 and vented through vent 84. When a purity is reached in the impure liquid oxygen stream that is equal to the production purity, normal operations are resumed and surge tank 22 is again connected to the lower pressure column 10. However, the delivery of the impure liquid oxygen stream to the heat exchanger allows cryogenic temperatures of the incoming air to be achieved in the heat exchanger 36 and therefore the cooling of the incoming air to cryogenic temperatures that are necessary for the distillation of the air to be conducted and for the air separation plant to be restarted.

An added advantage of standby pump 128 is that the flow circuit can be designed so that the main flow path 28 and the standby flow path 34 are parallel flow paths that can substituted for one another and therefore, standby pump 128 can serve as a backup to the main pump 40. To such end, the standby flow path 34 can incorporate a conduit 158 extending between the auxiliary tank 22 and the standby flow path. Valves 160 and 162 within conduit 158 can be opened to allow the standby pump 128 to provide the pumped liquid oxygen through the standby flow path 34 to the heat exchanger 36 or alternately to the auxiliary vaporizer 26 upon failure of the main pump 40. In case of a normal operation with the use of the standby pump 128, valves 160 and 162 would be set in open positions, valve 58 would be closed and valve 146 would be set in the open position to allow the pumped liquid oxygen produced by standby pump 128 to be vaporized in the heat exchanger 36. It is to be noted that valve 160 is an isolation valve and therefore, is normally set in an open position except where equipment is to be isolated for maintenance purposes. Alternately, in case of the transient operation, valves 146, 58 and 112 would be set in closed positions and valve 114 would be set in an open position to allow the standby pump 128 to supply pumped liquid oxygen to the auxiliary flow path 30 and the auxiliary vaporizer 26. Main pump 40 can also stand in for the standby pump 128 by incorporation of a conduit 164 within the main flow path 48 that supplies communication between the bottom region 14 of the lower pressure column 10 and the main pump 40. Where the main pump 40 is to serve as the standby pump 128, valves 168 and 170 provided in the conduit 164 can be set in open positions for such purposes. Again, valve 168 is an isolation valve that is normally set in the open position.

It is to be noted that conduit 164 and valve 168 allow for liquid to be continually pumped from the bottom region 14 of the lower pressure column 10 to the heat exchanger 36 during normal operation of the air separation plant 1. In such case, the surge tank 22 would simply accumulate liquid to maintain a standby supply of accumulated liquid in case of a plant failure. Consequently, a stream of the oxygen-rich liquid would flow to the surge tank 22 on an intermittent basis to maintain a stable supply of the accumulated liquid. During such a failure, valve 168 would be set in a closed position and valves 50 and 52 would be reset in open positions to allow the accumulated liquid within the surge tank 22 to be pumped by the main pump 40. Liquid from the reserve storage tank 24 would be used to replenish surge tank 22 in the manner described above. Further in another possible embodiment of the present invention a separate line could be provided to the conduit 64 to supply the reserve storage tank 24 with oxygen-rich liquid directly from the bottom region 14 of the lower pressure column 10.

It is preferred that the standby pump 128 be able to immediately take over pumping duty from the main pump 40 in case of a failure of the main pump 40. This can be accomplished by continually operating the standby pump 128 in a recirculation mode so that it remains at a low temperature. This is accomplished in the illustrated embodiment by a recirculation flow path within which liquid circulates. This recirculation flow path is provided by a conduit 172 connected to the standby flow path 34 and a conduit 174 connected to conduit 172 to the headspace of surge tank 22. When a valve 176 within conduit 172 is set in an open position, along with valves 160 and 162, a stream of the oxygen-rich liquid will flow in such recirculation path, from surge tank 22 to conduit 158, through pump 128 and then back to surge tank 22 through conduits 172 and 174. The main pump 40 is also able to function in a recirculation mode and as such, a conduit 178 is connected to the main flow path 28 and a conduit 180 is connected to the conduit 178 and the headspace of the surge tank 22. A valve 182 provided in conduit 180 can be set in an open position for such purpose. This would be used when pump 40 is the back-up pump or to control the flow and discharge pressure of pump 40 according to its pump characteristic curve. Control of flow and discharge pressure of standby pump 128 could similarly be accomplished with the use of conduit 174 and valve 176.

A yet further utility is provided by the illustrated flow network. As illustrated, conduits 172 and 178 are provided with control valves 184 and 186, respectively. These conduits terminate in the lower pressure column 10. When valve 184 or valve 186 is set in an open position and the associated pump is operated, namely, standby pump 128 or main pump 40, liquid will be pumped from the surge tank 22 back to the lower pressure column 10. At the same time, liquid will be added to the surge tank 22 from the reserve storage tank 24 through the backup flow path 32 as described above. What this would do is to add refrigeration back into the lower pressure column 10 in a liquid assist mode of operation where there was insufficient refrigeration being imparted to the plant due to, for instance, a failure or maintenance of, a turboexpander being used to supply plant refrigeration to the air separation plant 1. Additionally, such liquid could be added during a startup from ambient during a cool-down stage of the startup process.

It is important that there at all times be sufficient pressure at the suction side of the main and standby pumps 40 and 128 at all times. This can be effectuated by providing a portion or all the recirculation flow from the main pump 40, via valve 182, and/or backup pump 128, via valve 176, back to the surge tank whereby flash-off vapor produced by passage of the pumped liquid through the valves will provide vapor to the head space of surge tank 22. In addition, if controls are such that the recirculating flow is sent back directly to the low pressure column or else there is insufficient vapor in the recirculating flow, pressure can be generated within the tank with the use of an atmospheric pressure building circuit connected to the surge tank 22 in the form of an atmospheric vaporizer 188 in a flow circuit leading from the bottom of the surge tank 22 to the headspace thereof and provided by a conduit 200. A control valve 202 is provided to trim the flow within such flow circuit. A stream of the oxygen-rich liquid is vaporized by vaporizer 188 to provide vapor that is added back to the headspace of the surge tank for pressurization purposes. In lieu of or in addition to the foregoing, the gravitational head developed by the height of the surge tank could be used to supply the necessary suction pressure, but without the guarantee thereof. Overpressures within the surge tank can be vented back to the lower pressure column through conduits 204 and 206. A valve 208 in conduit 206 can be set in an open position for such purposes. Should the pressure be too great, excess vapor can simply be vented through vent line 210 connected to conduit 204 upon the setting of a valve 212 within vent line 210 into an open position.

While the present invention has been described with reference to a preferred embodiment, as will occur to those skilled in the art, numerous changes, additions and omissions can be made without departing from the spirit and scope of the invention as set forth in the appended claims.

We claim:

1. A method of backing up a supply oxygen in an air separation plant, said method comprising:

pumping a liquid oxygen stream composed of an oxygen-rich liquid, resulting from indirect heat exchange between downcoming liquid of a lower pressure column and nitrogen-rich vapor column overhead of a higher pressure column of the air separation plant, to produce a pumped liquid oxygen stream and heating the pumped liquid oxygen stream to produce the supply of the oxygen;

during normal operation of the air separation plant:

feeding streams of the oxygen-rich liquid to a surge tank and a reserve storage tank of larger volume than the surge tank and situated more remotely from the lower pressure column than the surge tank, at least on an intermittent basis, so that the oxygen rich liquid is accumulated in the surge tank and the oxygen-rich liquid is stored within the reserve storage tank as a backup supply; and heating the pumped liquid oxygen stream within a heat exchanger used in cooling at least a portion of the air to a temperature suitable for the cryogenic rectification thereof within the air separation plant, thereby to produce the supply of the oxygen during the normal operation; and during a transient operation of the air separation plant where the air separation plant has ceased operation:

isolating the surge tank so that the surge tank does not receive the oxygen-rich liquid;

pumping the liquid oxygen stream from the surge tank to produce the pumped liquid oxygen stream and heating the pumped liquid oxygen stream within an auxiliary vaporizer to produce the supply of the oxygen during the transient operation; and replenishing the surge tank with a back-up stream of the oxygen-rich liquid removed from the reserve storage tank, the back-up stream composed of the back-up supply within the reserve storage tank.

2. The method of claim 1, during the normal operation of the air separation plant, the surge tank continually receives one of the streams of the oxygen-rich liquid and thereby continually accumulates the oxygen-rich liquid within the surge tank and the liquid oxygen stream is pumped from the surge tank to produce the pumped liquid oxygen stream.

3. The method of claim 2, wherein:

during the normal operation of the air separation plant, the surge tank is connected to a bottom region of the lower pressure column to receive the one of the streams of the oxygen-rich liquid;

during the transient operation of the air separation plant, the air separation plant is restarted;

during the restart of the air separation plant, an impure liquid oxygen stream is separately pumped from the liquid oxygen stream from the bottom region of the lower pressure column and is thereafter, heated in the heat exchanger until a production purity is obtained in the impure liquid oxygen stream that is equal to that of the liquid oxygen stream; and after the production purity is obtained, the surge tank is reconnected to the bottom region of the lower pressure column to receive one of the streams of the oxygen rich liquid and the separate pumping of the impure liquid oxygen stream is ended.

4. The method of claim 3, wherein:

the liquid oxygen stream is pumped by a main pump and the impure liquid oxygen stream is pumped by a standby pump within two parallel flow paths, each, at one end, able to be selectively connected to the bottom region of the lower pressure column or alternatively, the surge tank and, at the other end, able to be selectively connected to the heat exchanger or, alternatively, the auxiliary vaporizer so that the standby pump is also able to pump the liquid oxygen in place of the main pump and the main pump is also able to pump the impure liquid oxygen stream in place of the standby pump; and the standby pump is continually operated during the normal operation of the air separation plant through recirculation of a portion of the oxygen-rich liquid along a recirculation path.

5. The method of claim 2, wherein the reserve storage tank is connected to the surge tank to receive another of the streams of the oxygen-rich liquid from the surge tank during normal operation of the air separation plant.

6. A backup system for backing up the supply of oxygen within an air separation plant, said supply system comprising:

a surge tank and a reserve storage tank adapted to receive streams of an oxygen-rich liquid resulting from indirect heat exchange between downcoming liquid of a lower pressure column and nitrogen-rich vapor column overhead of a higher pressure column of the air separation plant;

the reserve storage tank of larger volume than the surge tank and situated more remotely from the lower pressure column than the surge tank;

an auxiliary vaporizer;

a flow network having a main flow path, an auxiliary flow path and a backup flow path;

the main flow path connected to a heat exchanger used in cooling at least a portion of the air to a temperature suitable for the cryogenic rectification thereof and containing a main pump for pumping a liquid oxygen stream composed of the oxygen-rich liquid to produce a pumped liquid oxygen stream and to introduce the pumped liquid oxygen stream into the heat exchanger for heating the pumped liquid oxygen stream;

the auxiliary flow path extending between the main flow path, between the heat exchanger and the main pump and the auxiliary vaporizer for alternately heating the pumped liquid stream and thereby supplying the oxygen;

the backup flow path extending between the surge tank and reserve storage tank and containing a transfer pump to pump a backup stream of the oxygen-rich liquid to the surge tank and thereby replenish the surge tank with the oxygen-rich liquid; and a system of control valves within the flow network able to be selectively activated so that:

during normal operation of the air separation plant, the streams of the oxygen-rich liquid at least on an intermittent basis are fed to the surge tank and the reserve storage tank so that the oxygen rich liquid is accumulated in the surge tank and the oxygen-rich liquid is stored within the reserve storage tank as a backup supply and the pumped liquid oxygen stream is produced in the main flow path and is heated in the heat exchanger to supply the oxygen; and during a transient operation of the air separation plant where the air separation plant has ceased operation, the surge tank is isolated so that the surge tank does not receive the oxygen-rich liquid, the auxiliary flow path is connected to the main flow path so that the liquid oxygen stream is pumped from the surge tank by the main pump to the auxiliary vaporizer and the pumped liquid oxygen stream vaporizes in the auxiliary vaporizer to supply the oxygen and the surge tank is replenished with the backup stream through the backup flow path with the use of the transfer pump.

7. The backup system of claim 6, wherein:

the main flow path extends from the surge tank to the heat exchanger;

the system of control valves is able to be selectively activated such that during normal operation of the air separation plant, the surge tank continually receives one of the streams of the oxygen-rich liquid and the oxygen-rich liquid continually accumulates in the surge tank and the liquid oxygen stream is pumped by the main pump from the surge tank to produce the pumped liquid oxygen stream.

8. The backup system of claim 7, wherein:

the surge tank is connected to a bottom region of the lower pressure column to receive the one of the streams of the oxygen-rich liquid;

during the transient operation of the air separation plant, the air separation plant is restarted;

the flow network has a standby flow path extending between a bottom region of the lower pressure column to the heat exchanger and containing a standby pump able to be activated so that during the restart of the air separation plant, an impure liquid oxygen stream is separately pumped from the liquid oxygen stream from the bottom region of the lower pressure column and is thereafter, heated in the heat exchanger until a production purity is obtained in the impure liquid oxygen stream that is equal to that of the liquid oxygen stream; and the system of control valves is able to be selectively activated so that the standby flow path is able to be connected to the bottom region of the lower pressure column and the heat exchanger when the surge tank is isolated and alternatively, the standby flow path is able to be isolated from the bottom region of the lower pressure column and the heat exchanger when the production purity has been obtained and normal operation of the air separation plant is resumed.

9. The backup system of claim 8, wherein:

the main flow path and the standby flow paths are two parallel flow paths, each, at one end, extending between the bottom region of the lower pressure column and the surge tank and, at the other end, the heat exchanger and the auxiliary flow path;

the system of control valves is able to selectively connect each of the two parallel flow paths between the bottom of the lower pressure column and the heat exchanger, the surge tank and the heat exchanger and the surge tank and the auxiliary flow path so that the standby pump is also able to pump the liquid oxygen in place of the main pump and the main pump is also able to pump the impure liquid oxygen stream in place of the standby pump; and a recirculation path is connected to the standby path so that the standby pump is able continually operated during the normal operation of the air separation plant through recirculation of a portion of the oxygen-rich liquid along the recirculation path.

10. The supply system of claim 7, wherein the system of control valves is able to be selectively activated so that the reserve storage tank receives another of the streams of the oxygen-rich liquid from the surge tank and through the backup flow path to store the oxygen-rich liquid during normal operation of the air separation plant.

* * * * *